US006415525B1

(12) United States Patent
Watkins

(10) Patent No.: US 6,415,525 B1
(45) Date of Patent: Jul. 9, 2002

(54) MEASURING ARTICLE AND METHOD FOR SIZING COMPRESSION GARMENTS

(75) Inventor: William Bruce Campbell Watkins, Lawrenceville, GA (US)

(73) Assignee: Marlena International, LLC, Lawrenceville, GA (US)

( * ) Notice: Subject to any disclaimer, the term of this patent is extended or adjusted under 35 U.S.C. 154(b) by 0 days.

(21) Appl. No.: 09/409,321

(22) Filed: Sep. 30, 1999

Related U.S. Application Data

(60) Provisional application No. 60/102,876, filed on Oct. 2, 1998.

(51) Int. Cl.[7] ..... A41H 1/02; G01B 3/10

(52) U.S. Cl. ..... 33/759; 33/512; 33/679.1; 33/759

(58) Field of Search ..... 33/494, 511, 512, 33/679.1, 755, 759, 771, 2 A, 2 R, 3 R, 12, 14, 15, 16, 17 R

(56) References Cited

U.S. PATENT DOCUMENTS

| | | | | | |
|---|---|---|---|---|---|
| 798,223 | A | * | 8/1905 | Sole | 33/2 R |
| 869,264 | A | * | 10/1907 | Ricciardi | 33/2 R |
| 1,683,438 | A | * | 9/1928 | Billings | 33/679.1 |
| 2,929,146 | A | * | 3/1960 | McNeil | 33/759 |
| 3,292,261 | A | * | 12/1966 | Hayes | 33/2 R |
| 3,457,649 | A | * | 7/1969 | Rodgers | 33/759 |
| 3,832,780 | A | | 9/1974 | Lewis | 33/2 R |
| 3,849,886 | A | * | 11/1974 | Weyrick et al. | 33/2 R |
| 4,750,268 | A | * | 6/1988 | Ravid | 33/2 H |
| 4,811,489 | A | * | 3/1989 | Walker | 33/759 |
| 4,827,621 | A | * | 5/1989 | Borsuk | 33/758 |
| 4,920,659 | A | * | 5/1990 | Becher | 33/555.4 |
| 5,012,590 | A | * | 5/1991 | Wagner et al. | 33/759 |
| 5,230,158 | A | * | 7/1993 | Wall | 33/759 |
| 5,890,594 | A | * | 4/1999 | Hansen et al. | 206/472 |
| 6,145,215 | A | * | 11/2000 | Graston et al. | 33/759 |
| 6,338,723 | B1 | * | 1/2002 | Carpenter et al. | 602/75 |

FOREIGN PATENT DOCUMENTS

| | | | | |
|---|---|---|---|---|
| DE | 3223711 A1 | | 6/1982 | A61B/5/10 |
| FR | 2 278 278 | | 7/1973 | A41H/1/02 |
| GB | 2179743 A | | 5/1985 | G01B/3/10 |
| GB | 2209222 | * | 4/1989 | 33/771 |

* cited by examiner

*Primary Examiner*—Diego Gutierrez
*Assistant Examiner*—R. Alexander Smith
(74) *Attorney, Agent, or Firm*—Jason A. Bernstein; Bernstein & Assoc., P.C.

(57) ABSTRACT

A strip of material with at least one start marker and a plurality of rows of object markers designating body parts to be sized, directional markers designating orientation of the strip, size markers and size indicia. The size markers demarcate subranges of body part measurements and are arranged relative to the start marker. Size indicia are arranged between the size markers and designate and are correlated to garment sizes. Stretch characteristics of the garment being sized are accounted for by the use of adjusted size marker positions, a stretch material, or a compression/elasticity correlation graph. A method of sizing compression garments includes the steps of wrapping the measuring article generally around a body part, overlapping the measuring article with itself, reading the garment size indicia from the measuring article, and entering the garment size indicia in a garment order system. The proper garment size for the body part is determined directly by use of the measuring article without the need to annotate a body part measurement or refer to a conversion chart for garment sizes.

13 Claims, 5 Drawing Sheets

START
DIRECTION OF MEASUREMENT
FEMALE HIPS
FEMALE WAIST
FEMALE THIGH
MALE WAIST
UNISEX VEST CHEST
BRA CHEST
FEMALE ARM
UNISEX NECK
100
102
104
106
108
110
112
114
116
118
119
120
122
124
126
128
130
131

MEASURING ARTICLE AND METHOD FOR SIZING COMPRESSION GARMENTS

CROSS-REFERENCE TO RELATED APPLICATION

This application claims the priority benefit of U.S. Provisional Application Serial No. 60/102,876 filed Oct. 2, 1998, which is hereby incorporated by reference in its entirety.

FIELD OF THE INVENTION

The present invention relates generally to the patient sizing of compression garments for wound sites used during postoperative recovery, and more particularly, to a measuring strip article and method for sizing such garments on patients.

BACKGROUND OF THE INVENTION

Medical procedures such as plastic, aesthetic, reconstructive, and like surgeries, and injuries such as burns, generally result in one or more wound areas on the operated upon or injured body part or parts. Wound and injury healing is a complex science affected by many inter-related body functions. Arterial and venous blood flows, lymphatic drainage and body temperature are three key factors in the reduction of the time for a wound or injury to heal without complications. Such complications can include edema, seroma, hematoma, and infection, to name a few, which inhibit proper wound healing and are sometimes life-threatening. Current post-operative procedures and devices used by medical professionals do not consider the simultaneous interaction of the above-mentioned blood flows, lymphatic drainage and maintenance of body temperature with wound or injury healing.

Arterial and venous blood flows are intricately related and regulated by the body. Flow pressure ranges are important and remain within certain parameters; changes to them can greatly affect body function as well as wound healing. Arterial pressures normally remain with 120 mm Hg (systolic) and 80 mm Hg (diastolic) and, due to the muscular nature and structure of the body's arterial delivery system, remain relatively constant. On the other hand, venous pressures are more variable because veins are oftentimes compressed and consequently impede blood flow back to the heart. The central venous pressure is normally about 0 mm Hg while the venous resistance and the effect of hydrostatic pressure can vary the venous pressure up to about 100 mm Hg or more.

Key then to the continuous flow of arterial and venous blood flows is the venous pump. The veins are constantly being squeezed and compressed by the body's muscles and other external pressures. It is important to note that the function of the venous system is extremely important to the circulatory filling pressure, an important determinant of cardiac output. The slightest improvement of venous tone and venous filling ultimately will positively affect cardiac output, which can be correlated to as an important factor to improved wound healing. External compression garments are commonly prescribed as an aid to a reduction in venous flows such as varicose veins.

The lymph system is an accessory route used by the body to maintain fluid balance between the interstitial spaces and the blood. Most of the fluid escaping from the capillaries is reabsorbed into the venous capillaries but the remaining 10%, or so, is key both to life function and wound healing.

The lymph system, with this small amount of fluid, can also carry proteins and particulate matter away from tissue spaces (i.e., a wound site) that would not normally be removed by capillary action. The action of this function of the large vessel lymph system is called the lymphatic pump and is an intricate, fine functioning system of major lymph vessels and valves. Key to this is that the large lymph vessels can be compressed by the walls of the lymphatics themselves or by additional pressures from the surrounding surfaces. This same function in the large vessels occurs in the lymph capillaries.

During the normal postoperative period, the patient is restricted from activity, and is sometimes confined to a bed. This quiet period is contraindicated for the lymphatic pump action as there are no external factors to increase lymphatic flow during a time that the body most likely has need of such flow, for example, to reduce the occurrence of edema, seroma, hematoma and other complications. An externally applied compression would be helpful and advantageous to promote the beneficial lymphatic flow.

As mentioned above, the removal of proteins from the interstitial fluid has an important balancing effect. Proteins, in other than proper amounts, can affect tissue colloid osmotic pressures, which can affect capillary fluid absorption and interstitial fluid volumes and pressures. Interstitial fluid pressures are normally negative and are maintained this way by a proper functioning lymphatic pump but even more so by the removal of excess proteins. The area around the postoperative wound site has been most likely traumatized by a number of factors and thus the proper functioning if the wound site has been reduced. External compression can aid the body and more specifically lymphatic flows to maintain protein balances by maintaining the normal "dry" state of the interstitial spaces.

Common postoperative complications directly relating to interstitial fluid spaces include edema, seroma and hematoma, as noted hereinabove. Many factors can cause the interstitial pressures to increase and without a similar increase in fluid flows, there is a fluid buildup or edema. A stretch of the tissue spaces occurs with edemas of more than a few days, sometimes even a few hours, so proper and immediate treatment is important. Further to the stretch of the tissue is the fact that this excess fluid disrupts the normal absorption and use of tissue nutrients as the cells are now further from the capillaries. In the case of a wound site, this will slow the recuperative capacities of the body to heal the wound. Seromas can also affect the wound or injury site as does edema but, additionally, the danger of infection is increased. A hematoma similarly affects the wound site.

It should also be noted that arterial, venous and lymphatic pressures and flows are intricately balanced and interrelated. Additionally, the interstitial fluid volume and pressures are also balanced with these systems. The skin acts as the body's normal enclosure and it has its own elastic characteristics. Injury or wounds may disrupt the normal fluid and pressure balances causing fluids to build up and the skin stretches or contracts depending on the time from injury.

It is possible to proactively address the possibility of complications by applying external pressure immediately postoperatively with the intent of increasing capillary pressures and lymphatic flows, with a target range of about 17 to 32 mm Hg above the normal capillary pressure. This can be done with a properly designed, sized and applied compression garment.

Compression garments such as elastic bandages, dressings, girdles, vests, facial bandages, arm bandages, surgical bras, briefs, body suits, gloves, leg bandages, and trunk bandages are commonly used in the treatment of these cases with generally favorable results. However, there are well-known cases of the use of such articles that due to their design, material composition, sizing or application actually worsened the patient condition and caused complications. The correct application of compression is critical to enable the garment to perform within the intricate requirements of the body's systems as described hereinabove. A garment that is properly sized and applied performs as good or better than skin in stretch, compression, and thermoregulation, and is greatly beneficial in promoting proper and rapid healing in the patient's postoperative regime.

Compression garments are typically made and sold in a fixed range of sizes, unless custom-made garments are required. Accurately fitting the user with a garment that is the correct size, to thereby provide the desired compression, elasticity, and moisture absorption, is problematic when exact measurements are requested. Typically, to size a compression garment, an attendant must precisely measure a body part in inches or centimeters, make a notation of the measurement, look up the measurement in a conversion chart to determine the appropriate garment size such as small, medium, large, etc., and finally, order the proper size garment from an inventory.

The possibility of human error is thus introduced into the process at two steps, when the attendant takes the measurement and, as a greater concern, when the attendant looks up the measurement in a conversion chart. The too common result of misreading the conversion chart is that an improperly sized garment is applied during early post-operative period which is most critical to the proper and speedy recuperation of the wound.

Furthermore, known conversion charts merely provide a cross-reference of a body part measurement to a garment size based on conventional garment sizes. For example, a waist measurement of 34" is cross-referenced to a garment size of "medium." This methodology does not take into account the change in compression applied to an object as the stretch fabric is stretched around the object or the desired compression to be applied to a wound or burn site.

Compression garments are usually constructed of commercially available elastic/stretch fabrics and/or moisture-absorbing fabrics. One such fabric is described in U.S. patent application Ser. No. 09/127,208, filed Jul. 7, 1998, now U.S. Pat. No. 5,994,912, issued to Watkins. Stretch fabrics are commonly made of a spandex material such as LYCRA®. Spandex is a complex, synthetic, elastomeric material with stretch up to 500–600% or more and is typically blended with other types of fibers such as polyesters, cottons, nylons and other commercially available materials. Along with these different fiber blends, different fabric construction methods can be used such as weaving and knitting. Within knitting, tricot and raschel constructions are commonly used. Additionally, there is a known stretch fabric that is constructed of similar fibers but manufactured into a web.

These fabrics perform in differing ways as they stretch across the body. As described hereinabove, it is important that the fabric's compressive properties be correlated to the fabric's stretch so that compression garments made of the stretch fabric can be properly sized. Known compression garment sizing articles or procedures do not adequately take into consideration these properties of stretch fabrics.

What is needed but not available in the prior art is a measuring article and method that provides for quick and accurate compression garment sizing to achieve the desired compression, elasticity, and moisture absorption at the wound site without having to make a precise numerical notation of a body part measurement or to refer to a conversion chart for proper garment sizing.

SUMMARY OF THE INVENTION

Generally described, the present invention provides a measuring article for determining a garment size from a measurement range of an object. The measuring article has a strip of material with a first end and a first surface. The first surface has at least one row of size indicia and size markers thereon. The size markers include a first size marker positioned a distance from the first end corresponding to the smallest measurement of the range of measurements, a last size marker positioned a distance from the first end corresponding to the largest measurement of the range of measurements, and at least one intermediate size marker positioned between the first marker and the last marker. Spaces are defined between the size markers, the spaces and the size marker positions corresponding to object measurement subranges correlated to the garment sizes. At least one size indicia designating the corresponding garment size is arranged within each of the spaces.

A first preferred embodiment of the present invention further provides a start marker on the first surface generally proximate the first end of the strip. At least one object indicia and at least one directional indicia are provided between the first end and the first size marker. Also, the strip has a second end, with at least one object indicia and at least one directional indicia provided between the last size marker and the second end. In an alternate first preferred embodiment, the size marker positions are adjusted to correlate the desired pressure to be applied to a wound or burn site to the elastic deformation of the garment material.

The size indicia are preferably a group of words, symbols, and/or abbreviations, such as but not limited to "XXXS", "XXS", "XS", "S", "M", "L", "XL", "XXXL", and "XXXL" or other size indicia systems, whether standard, customized, or unique. The object indicia are preferably selected from a group of words describing the garment or body part being measured, such as but not limited to "neck", "vest", "bra chest", "arm", "waist", "hips", "thigh", and "brief". The directional indicia are preferably provided by arrows, triangles, or other indicia.

The markers and indicia are preferably arranged in rows, with each row arranged for measuring a different body part for a certain garment type. Also, a second surface may have a plurality of size markers and size indicia thereon in an arrangement substantially the same as the size markers and the size indicia of the first surface. Thus, the measuring article may have four or more rows of markers and indicia on each of the two surfaces.

A second preferred embodiment of the present invention provides the measuring article of the first embodiment, with rows of markers and indicia starting at each end of the strip. A single measuring article of a given size can thus be used on more different body parts.

A third preferred embodiment of the present invention provides the measuring article of the first embodiment, with the strip made of an elastomeric material. The material is preferably selected to have an elasticity that is substantially the same as the elasticity of the garment material.

A method of determining a garment size for a body part provides the steps of wrapping a measuring article as described above generally around the body part, overlapping the first end or start marker of the measuring article with the garment size indicia between two garment size markers of the measuring article, reading the garment size indicia from the measuring article, and, entering the garment size indicia in a garment order system. The proper garment size for the body part is determined directly by use of the measuring article without the need to annotate a body part measurement or refer to a conversion chart for garment sizes.

The method may further include correlating a body part measurement to a garment size based upon a graph showing elasticity plotted against compression for stretch fabric. Also, the method may provide the step of determining an object indicia for the body part to be sized from a plurality of rows of different object indicia. Further, the method steps described above can be repeated for additional body parts.

Accordingly, it is an object of the present invention to provide a measuring article for quickly and easily sizing compression garments for body parts or other objects without the need to measure the body part, make a notation of the measurement, and refer to a conversion chart to obtain the corresponding garment size.

It is another object of the present invention to provide for accurate measuring of a body part and accurate sizing of a compression garment for the body part to thereby promote quick healing of a wound associated with the body part.

It is yet another object of the present invention to provide a measuring article that may be disposed after use for sterility purposes.

It is still another object of the present invention to provide for direct garment sizing for most any body part from a single measuring article.

It is a further object to provide a method of quickly and accurately measuring a body part and determining the appropriate size of a compression garment therefor.

These and other objects, features, and advantages of the present invention are discussed or apparent in the following detailed description of the invention, in conjunction with the accompanying drawings and the appended claims.

BRIEF DESCRIPTION OF THE DRAWINGS

The invention is illustrated in the drawings in which like reference characters designate the same or similar parts throughout the several figures of which.

DETAILED DESCRIPTION OF THE PREFERRED EMBODIMENTS

Figure 1:
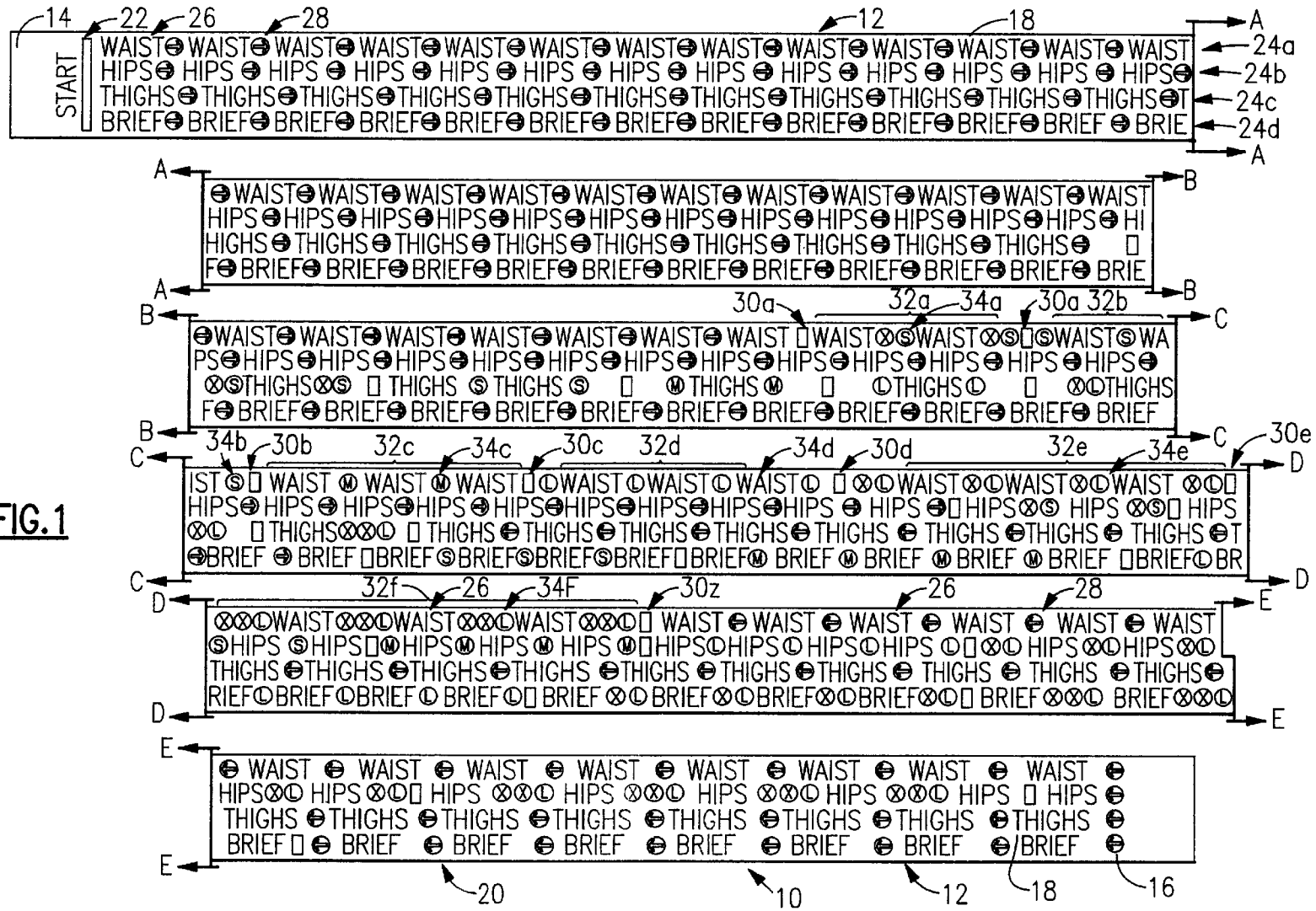
FIG. 1 is schematic view of a first side of a measuring article according to a first preferred embodiment of the present invention.

Referring now to FIG. 1, there is illustrated a first preferred embodiment of the present measuring article, referred to generally as 10. The measuring article 10 has a generally thin and elongated strip 12 made of a fabric, plastic, paper, or other material known to those skilled in the art. The material is selected to provide sufficient flexibility to allow the article to be wrapped around a body part such as a person's arm or chest, and is preferably further selected to be inexpensive and disposable. The strip 12 may be coiled into a roll, folded, provided on a reel, or provided in other arrangements known to those skilled in the art, and unrolled, unfolded or the like for use thereof.

The strip 12 has a first end 14 and an opposite second end 16, and a first generally flat surface 18 and an opposite second generally flat surface 20. The first surface 18 has a start marker 22 or like "start" indicia formed thereon generally proximate to the first end 14. The start marker 22 may be formed on the first surface 18 by printing, engraving, or other marking methods known to those skilled in the art. Other markings and indicia formed on article 10 and described hereinbelow may be formed on the article by similar techniques.

At least one and preferably a plurality of indicia rows 24 are arranged on the first surface 18. Each indicia row 24 is correlated to a specific object to be measured, for example, a body part such as but not limited to a person's neck, vest, bra, chest, arm, waist, hips, thigh, and/or brief. Such correlation is provided by each row 24 having at least one and preferably a plurality of substantially identical object indicia 26 formed thereon in a repeating pattern, preferably beginning generally proximate to the start marker 22, that designates the object to be measured, for example, the waist. The object indicia 26 may be provided additionally designating the preferred gender of the patient where applicable. Also, the object indicia 26 may be provided in English or another language such as but not limited to Spanish, Portuguese, Italian, Dutch, German, and French.

At least one and preferably a plurality of substantially identical directional indicia 28 are preferably provided in each row 24 in a repeating pattern and are preferably interposed with the object indicia 26. The directional indicia 28 are arranged to designate the direction generally away from the start marker 22 and toward a plurality of substantially identical size markers 30.

The size markers 30 are arranged with a first size marker 30*a* positioned relative to the start marker 22 a distance substantially equal to a smallest measurement of a typical range of measurements of object sizes. A last size marker 30*z* is positioned relative to the start marker 22 a distance substantially equal to a largest measurement of the range. In the present field, body parts are typically sized by circumference measurements as the appropriate compression fit provided by a garment is of primary consideration. For example, the male and/or female waist region typically has a circumference measurement in the range of about 23½ inches to about 39½ inches, so the first size marker 30*a* may be located about 23½ inches from the start marker 22 and the last size marker 30*z* about 39½ inches therefrom.

At least one and typical a plurality of intermediate size markers such as markers 30*b*, 30*c*, 30*d*, and 30*e*, and 30*f* are arranged with spaces 32 therebetween such as spaces 32*a*, 32*b*, 32*c*, 32*d*, 32*e*, and 32*f*. At least one garment size indicia 34 is arranged within each of the spaces 32. The size indicia 34 may comprise words, symbols or abbreviations such as XS, S, M, L, XL, and XXL, 34*a*–34*f* respectively. The size markers 30 and spaces 32 are arranged to demarcate the typical subranges of object sizes, and the size indicia 34 are selected to correspond to the typical garment sizes correlated to the object measurement subranges. Additional object indicia 26 may also be arranged within the spaces 32.

Accordingly, the number of spaces 32 and size indicia 34 may vary relative to the number of typical size subranges for an object, and the size indicia 34 are arranged relative to the start marker 22 in order of increasing garment size. There may also be provided object indicia 26 and directional indicia 28 arranged on the first surface 18 between the last size marker 32z and the second end 16 of the article 10.

It should be noted that there are body parts such as the neck which typically have a relatively small variance in circumference size and/or corresponding garment size from person to person, and thus there may be required only, for example, two size indicia 34 within two spaces 32 between three size markers 30. Furthermore, there are body parts such as the upper arm that typically have a relatively large variance in circumference and/or corresponding garment size from person to person and thus may require larger numbers of size indicia 34, spaces 32,. and size markers 30. Furthermore, while the present article 10 is provided for circumference measurements, it may also be suitably employed for use in length or other size measurements.

Figure 2:
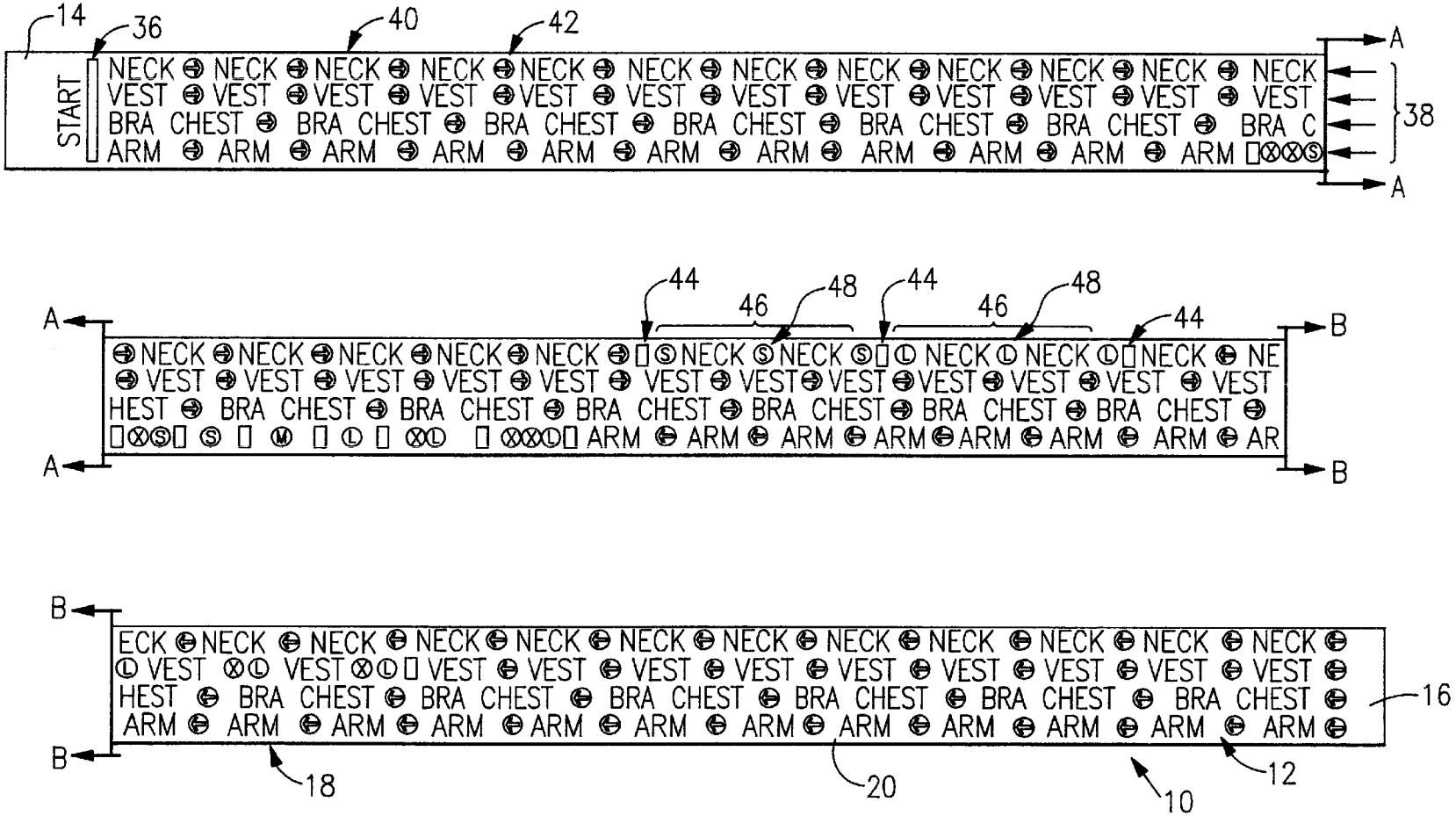
FIG. 2 is a schematic view of a representative portion of a second side of the measuring article of FIG. 1.

Referring now to FIG. 2, the second surface 20 has a start marker 36 or like "start" indicia formed thereon generally proximate to the first end 14 or the second end 16, similar to the arrangement on the first surface 18. The second surface 20 preferably has rows 38 of object indicia 40, directional markers 42, size markers 44, spacings 46 between the size markers 44, and size indicia 48 in a similar arrangement to the first surface 18 and corresponding to body parts, body part measurements, and garment sizes.

It should be noted that the number, body part designation, and sequence of rows 24 and 38 of the preferred embodiment as shown in the drawing figures is provided for illustrative purposes. Specifically, the first surface 18 is shown with four rows 24*a*, 24*b*, 24*c*, and 24*d* sequentially designating the waist, hips, thighs, and brief, respectively (see FIG. 1). The second surface 20 is shown with four rows 38*a*, 38*b*, 38*c*, and 38*d* sequentially designating the neck, vest, bra/chest, and arm, respectively. The preferred embodiment described herein is desirable because, inter alia, it provides for measurement of most any body part typically desired to be sized for a compression garment and also provides for the sizing of body parts starting at the upper body and progressing generally downward. The present invention further contemplates, however, additional embodiments having the same body part designations in different sequences and/or fewer or additional body part designations.

Figure 3:
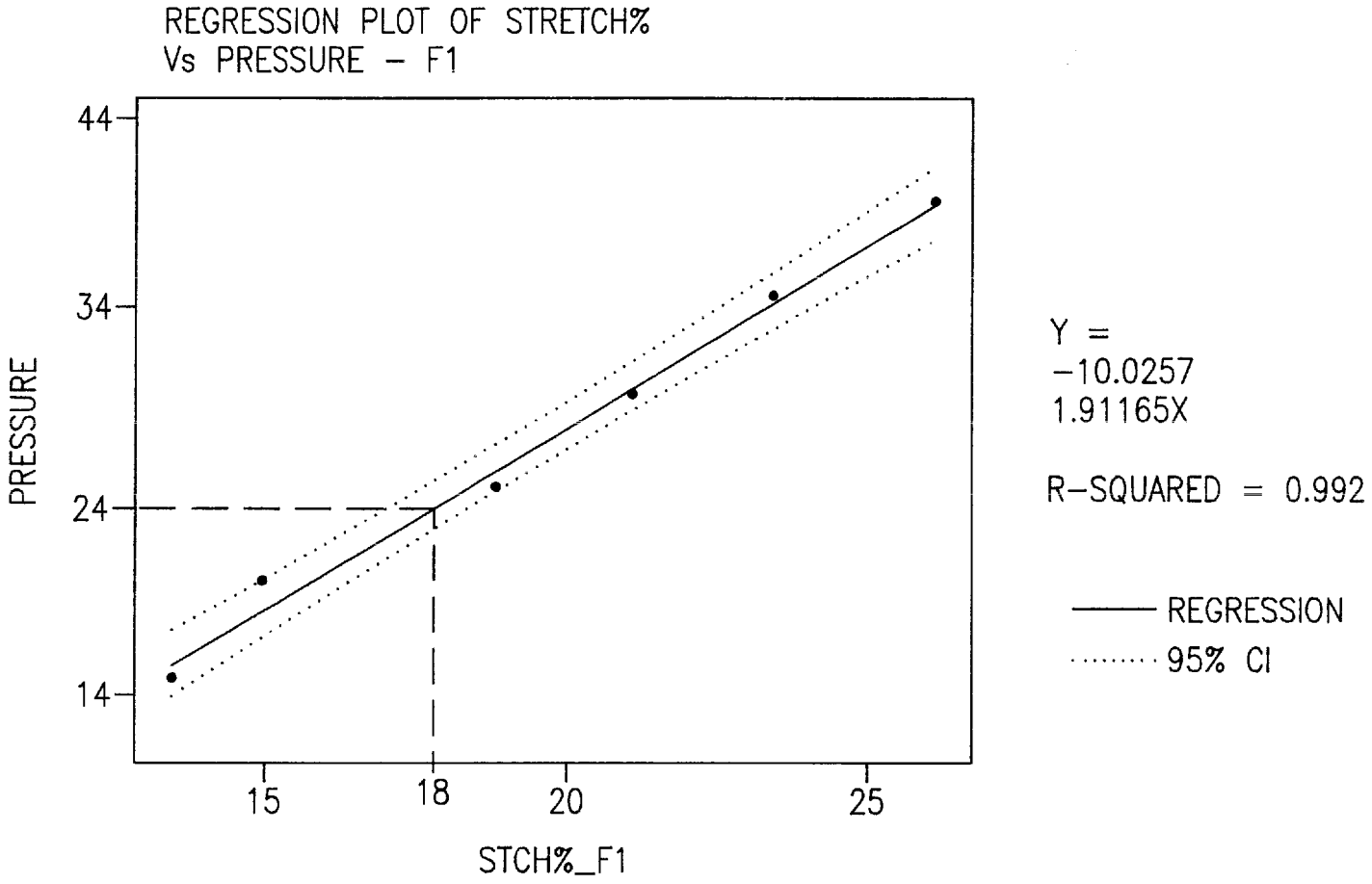
FIG. 3 is a graph showing pressure plotted against stretch % for a garment stretch material.

Referring now to FIG. 3, there is illustrated a graph of pressure plotted against stretch % for a given garment stretch material. The graph can thus be used to find a deformation (stretch %) value for the material when stretched around a body part that will produce a predetermined pressure to be applied to the body part. Other graphs may be plotted to determine the pressure produced by various other fabrics when stretched.

In the first preferred embodiment, the positions of the size markers 30 may be selected to generally correspond to the actual measurement subranges of the body part to be measured. In an alternate first preferred embodiment, the size marker 30 positions are adjusted to correspond to less than the actual measurement ranges to account for the elastic deformation of the garment material, where the adjusted positions are determined from the pressure versus stretch % plot of FIG. 3. Using a measuring article 10 made of the stretch fabric of the plot of FIG. 3 as an example, where for a given wound or burn a pressure of 24 mm Hg applied to the site is desired then the material should be stretched about 18%. Thus, instead of the size markers 30 being positioned for example 4" apart in accordance with the actual measurement subrange for a "medium" waist of 32" to 36", size markers 30 positions are adjusted to be 18% less than 4" apart. Thus, the garment is more accurately sized so that the desired pressure is applied to the wound or burn site.

Figure 4:
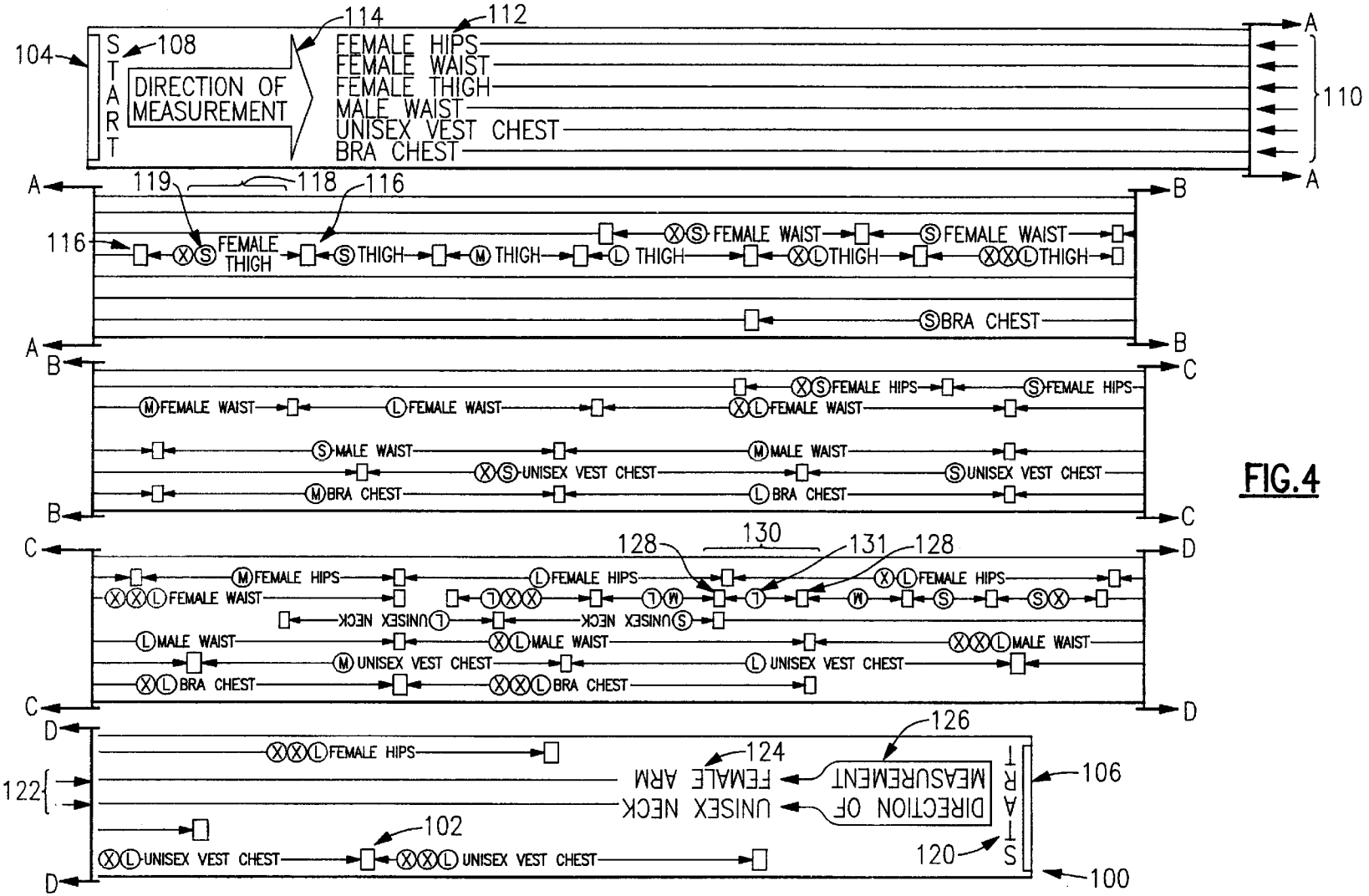
FIG. 4 is schematic view of a first side of a measuring article according to a second preferred embodiment of the present invention.
Figure 5:
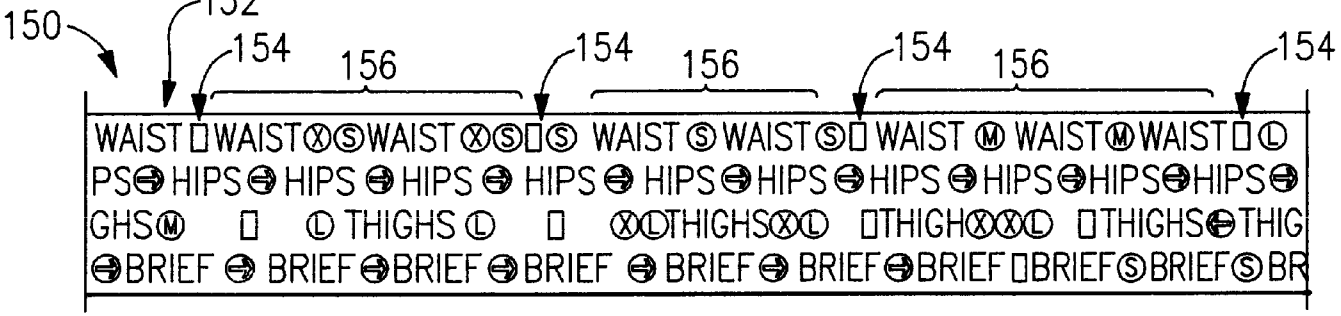
FIG. 5 is schematic view of a representative portion of a measuring article in a relaxed state according to a third preferred embodiment of the present invention.
Figure 6:
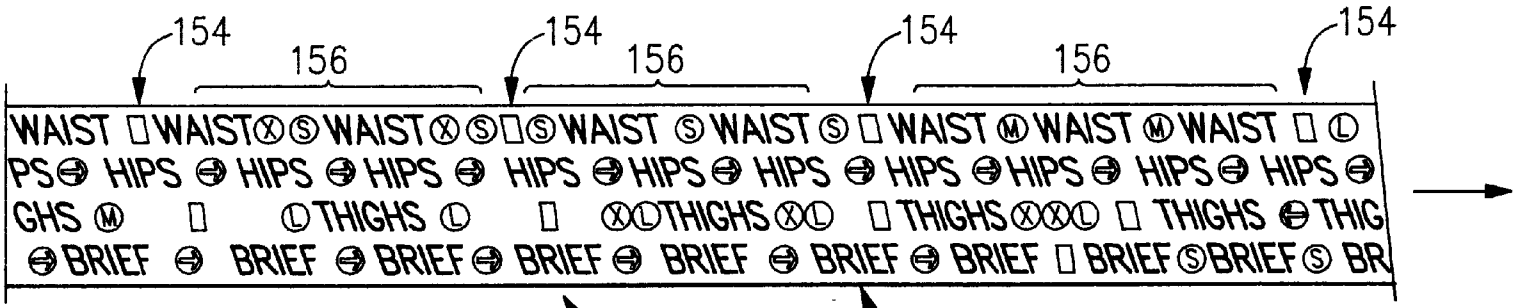
FIG. 6 is a schematic view of a representative portion of the measuring article of FIG. 1 in a tensioned state.

Referring now to FIG. 4, a second preferred embodiment of the present invention provides a measuring article 100 similar to the measuring article 10 of the first preferred embodiment and having a strip 102 with a first end 104 and a second end 106. A first start marker 108 is formed on the strip 102 generally proximate to the first end 104, and the strip 102 preferably has first end rows 110 of object indicia 112, directional markers 114, size markers 116, spacings 118 between the size markers 116, and size indicia 119 in a similar arrangement to the first preferred embodiment and corresponding to body parts, body part measurements, and garment sizes. There is additionally provided a second start marker 120 on the strip 102 generally proximate to the second end 106, and the strip 102 preferably has second end rows 122 of object indicia 124, directional markers 126, size markers 128, spacings 130 between the size markers 128, and size indicia 131 in a similar arrangement to the first end rows 110 and corresponding to body parts, body part measurements, and garment sizes. This embodiment allows more rows 110, 122 of markers and indicia 112, 114, 116, 124, 126, 128, on a given width of the strip 102, thereby permitting additional body parts to be measured with a single measuring article relative to the first preferred embodiment. In particular, rows 110, 122 for objects with relatively smaller measurement ranges can be arranged colinearly on the strip 102 for maximum use of space. Referring now to FIGS. 5 and 6, a third preferred embodiment of the present invention provides a measuring article 150 similar to the measuring article 10 of the first preferred embodiment and having a strip 152 made of a material such as a fabric or the like further having elastic properties. The material is selected to provide an elasticity such that the article 150 is normally at a relaxed state (see FIG. 5) and may be deformed to a tensioned state when measuring a body part (see FIG. 6). The degree of elasticity is selected to be substantially the same as an elasticity of a material of a conventional compression garment for which the body part is being sized. Such conventional compression garments are generally made of a spandex blend or the like and are provided in various constructions, as described hereinabove. The typical elastic characteristics of such compression materials is shown in the graph of FIG. 3 which may be used to select the elastic material of the strip 152 in correlation thereto.

Size markers 154 and spaces 156 therebetween are provided on the article 150 and are calibrated to the elasticity of the compression garment. Thus, in the tensioned state the size markers 154 and the spaces 156 are positioned similarly to the article 10. In the normal relaxed state, however, the size markers 154 are closer together and accordingly the spaces 156 are smaller relative to the article 10 (and relative to the actual measurements of the body parts). The measuring article 150 therefore has a strip 152 with a lesser length in the normal state than the strip 10 of the first embodiment. The measuring article 150 of the third embodiment thereby provides for increased accuracy in the sizing of compression garments for injured body parts.

The present invention also provides a method for determining a garment size for a body part. The user first manually wraps a measuring article 10 of the general type described hereinabove generally around the body part to be measured, e.g., the patient's waist. The measuring article 10 is wrapped snugly around the body part, but not so snug as be constricting, so that the measuring article generally encircles the body part and the start marker 24 or 38 overlaps the strip 12 at a position having size indicia 34 or 48 between the size markers 30 or 44.

Where the measuring article 10 has a plurality of rows 24 or 38 of indicia and markers corresponding to different body parts, the user reads the object indicia 26 or 40 designating the body part for which the garment is being sized. The article 10 is removed from the patient's waist and the user notes the garment size indicia 34 or 48 where the start marker 24 or 38 overlaps the strip 12 in the row 24 or 38 with the object indicia 26 or 40 for the designated body part. Since most waist sizes fit into a subrange of size ranges, the overlap position is typically between two of the size markers 30 or 44. The user can read from the measuring article 10 the size indicia 34 or 48 between the two size markers 30 or 44. Thus, this size indicia 34 or 48 directly provides the user with the proper size of garment to use. The size is noted on a patient prescription form or otherwise entered into a garment order system. The method may then be repeated as desired for additional body parts using the same or a different measuring article 10.

The present method may include the use a garment order system such as the prescription order form which has a graph (see FIG. 3) showing elasticity plotted against compression for stretch fabric used in typical compression garments. The graph can be easily read to by the user to correlate a body part measurement to a garment size even more accurately and to record this information for the patient or doctor.

The measuring article and method thereby eliminate the need for a user to precisely measure a body part size in inches or centimeters and then look up the measurement in a conversion chart to determine whether a small, medium, large, etc., size garment is to be ordered. The task of looking up the measurement in the conversion chart is a common source of error that results in improperly sized compression garments. With the measuring article 10, the user can directly determine the appropriate garment size without having to refer to the conversion chart.

For example, many person's waists have a measurement in the range of 33 inches to 36 inches. When sizing a garment for a person whose waist measurement is 34 inches, normally the patient must measure themselves in inches or centimeters and then look up the proper garment size on a conversion chart. The present measuring article 10 may have, among other indicia, the word "waist" printed thereon for designating that particular body part and, among other indicia, the word "medium" or the abbreviation "M" printed thereon at a position between 33 inches and 36 inches from the first end 14 or start marker 22 or 36 of the strip 12. The user may thus make use of the measuring article 10 to directly determine that a medium size garment is required without having to consult a conversion chart.

One can thus use the present invention to correlate a body part size range to a specific compression within a certain variance. To a physician, this will be key data that is not available today other than in a speculative or subjective way. The present measuring article 10 and use thereof provides for dramatically increasing the speed and accuracy of sizing of compression garments which results in better fit, i.e., performance in healing a wound or injury.

Accordingly, there are a number of advantages provided by the present invention. The measuring article has a strip with size markers and indicia and object indicia that correlate object size ranges to garment sizes, providing the benefit of quick and easy sizing of compression garments for body parts or other objects without the need to measure the object, make a notation of the measurement, and refer to a conversion chart to obtain the corresponding garment size.

Additionally, the measuring article has a plurality of size indicia and markers on each side, providing the benefit of permitting sizing of garments for most any body part from a single measuring article.

Also, the measuring article is capable of economical manufacture from an inexpensive material, providing the benefit of disposability after use for sterility purposes.

Furthermore, the strip can be made of a material having an elasticity corresponding to the elasticity of conventional compression garments, providing the benefit of accurate measuring of a body part and accurate sizing of a compression garment for the body part to thereby promote quick healing of a wound associated with the body part.

Moreover, the present invention provides a method of determining a garment size for a body part using a measuring article of the general type described herein that provides for quickly and accurately measuring a body part and determining the appropriate size of a compression garment therefor.

It should be noted that the present invention as described herein is directed to a measuring article and method of use thereof for sizing post-operative and therapeutic compression garments typically used after plastic, aesthetic, reconstructive, orthopedic, general, and like surgical and burn treatment applications where quick and accurate sizing of a compression garment is desired for a wound site on an object such as a body part. However, the present invention further contemplates a measuring article and use thereof as generally described herein for other applications such as but not limited to orthopetic and general surgeries, post-bum recovery, veterinary applications, and other applications where quick and accurate sizing of any type of compression or non-compression garment is desired for an object such as a body part.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A measuring article for determining a size of an elastic compression garment from a measurement range of an object, comprising:

a) a strip of material having a first end, a second opposite end, a first substantially flat surface having at least one row of size indicia, object indicia, directional indicia, start markers and size markers formed on said first planar surface and in proximity to each of said first and second ends, and, a second substantially flat surface on the obverse side of said strip of material;

b) said size markers in each row in proximity to said first end and said size markers in each row in proximity to said second end, each comprising a first size marker positioned a distance from one of said ends, said first size marker distance correlated to a smallest measurement of said range of measurements and said elasticity of said garment such that said first size marker distance is less than said smallest measurement to account for said elasticity of said garment;

c) said size markers comprising a first size marker positioned a distance from said first end and a last size marker positioned a distance from said second end, said last size marker distance correlated to a largest measurement of said range of measurements and said elasticity of said garment such that said last size marker distance is less than said largest measurement to account for said elasticity of said garment;

d) said size markers comprising at least one intermediate size marker positioned between said first size marker and said last size marker to define a first space between said first size marker and one of said intermediate size markers and a second space between one of said intermediate size markers and said last size marker;

e) said size indicia comprising a size indicia arranged within each of said spaces, f) said object indicia in each row comprising a description of the body zone being measured by said row;

g) said directional indicia in each row comprising a visual indicator of which direction to measure from said first or second end beginning at corresponding start marker and continuing to the first size marker that is positioned a distance from said first or second end; and, h) said directional indicia in each row also comprising a visual indicator of the size range for each size indicia and at least one of said visual indicators beginning from said first size marker and continuing to said last size marker wherein said strip is capable of being wrapped around said object so that said first end may overlap with said strip at a position having one of said size indicia thereby indicating the appropriate size of the elastic garment for the object.

2. The measuring article of claim 1, wherein said at least one size indicia comprise the markings "XXS", "XS", "S", "M", "L", "XL", "XXL", "XXXL" and "XXXL".

3. The measuring article of claim 1, wherein one of said start markers is arranged on said first surface generally proximate to said first end and one of said start markers is arranged on said first surface generally proximate to said second end.

4. The measuring article of claim 1, wherein said at least one row comprises said at least one directional indicia arranged between said first end and said first size marker.

5. The measuring article of claim 4, wherein said at least one object indicia at said first end comprise the markings "neck", "vest", "bra chest", "arm", "waist", "hips", "thigh", and "brief" and said at least one object indicia at said first end comprise the markings "unisex neck" and "female arm", said at least one object indicia being printed continuously within each size range within each measurement row.

6. The measuring article of claim 4, wherein said directional indicia comprise at least one arrow, said at least one arrow beginning at the start marker in each row at the first and second end and continuing to the first size marker for said row and said at least one arrow also indicating the size range for a specific size indicia by beginning at the intermediate size marker closest to said start marker for the specific size and ending at the intermediate size marker farthest from said start marker for said specific size.

7. The measuring article of claim 1, wherein said strip is made of a material having an elasticity.

8. The measuring article of claim 1, wherein said strip of material is made of a flexible material.

9. A method of determining a size of an elastic compression garment for delivering a desired pressure to a body part, comprising the steps of:

a) wrapping a measuring article generally around said body part, said article comprising a strip of material having a first end and a first surface, at least one first size marker positioned on said surface a distance from said first end with said first size marker distance correlated to a smallest measurement of a range of measurements for said body part and said elasticity of said garment such that said first size marker distance is less than said smallest measurement to account for said elasticity of said garment, at least one last size marker positioned on said surface a distance from said first end with said last size marker distance correlated to a largest measurement of said range of measurements and said elasticity of said garment such that said last size marker distance is less than said largest measurement to account for said elasticity of said garment, at least one intermediate size marker positioned on said surface between said first size marker and said last size marker to define a first space between said first size marker and one of said intermediate size markers and a second space between one of said intermediate size markers and said last size marker, and, at least one size indicia on said surface and arranged between said first and last size markers b) overlapping said first end of said measuring article with one of said size indicia between two of said first, second, or intermediate size markers of said measuring article; and c) determining said garment size for said body part by reading said size indicia proximate said first end directly from said measuring article;

wherein said garment size for said body part is determined directly by use of said measuring article without the need to annotate a body part measurement or refer to a conversion chart for garment sizes.

10. The method of claim 9, wherein said step of reading said object indicia includes reading from the group consisting of "neck", "vest", "bra chest", "arm", "waist", "hips", "thigh", and "brief" and the step of reading said size indicia includes the step of reading from the group consisting of "XXXS", "XXS", "XS", "S", "M", "L", "XL", "XXL", and "XXXL".

11. The method of claim 9, further comprising the steps of repeating said steps (a) through (d) for at least one additional body part.

12. The method of claim 9, wherein said first size marker distance and said first space are correlated to said smallest measurement and said garment elasticity so that the garment size determined provides for a desired pressure delivered by the elastic compression garment to the object.

13. The method of claim 9, wherein said last size marker distance and said second space are correlated to said largest measurement and said garment elasticity so that the garment size determined provides for a desired pressure delivered by the elastic compression garment to the object.

* * * * *